United States Patent [19]

Gross

[11] Patent Number: 4,941,490

[45] Date of Patent: Jul. 17, 1990

[54] LOW TEMPERATURE APPARATUS FOR CLEANING JEWELRY AND GEMS

[76] Inventor: Stanley Gross, 1311 Green Rd., Roslyn, Pa. 19001

[21] Appl. No.: 321,677

[22] Filed: Mar. 10, 1989

[51] Int. Cl.[5] ..... B08B 3/02

[52] U.S. Cl. ..... 134/98; 134/101; 134/102; 134/108; 134/111

[58] Field of Search ..... 134/102, 95, 98, 101, 134/107, 108, 111

[56] References Cited

U.S. PATENT DOCUMENTS

| | | | |
|---|---|---|---|
| 1,587,950 | 6/1926 | Hare . | |
| 2,526,265 | 10/1950 | Nulph | 134/198 X |
| 3,069,094 | 12/1962 | Haloski et al. | 134/102 X |
| 3,675,855 | 7/1972 | Harwood et al. | 239/597 |
| 3,771,539 | 11/1973 | DeSantis | 134/102 X |
| 4,137,929 | 2/1979 | Grossman | 134/182 |
| 4,380,308 | 4/1983 | Greenwood | 134/102 X |
| 4,615,744 | 10/1986 | Murtha | 134/108 X |

FOREIGN PATENT DOCUMENTS

| | | | |
|---|---|---|---|
| 520413 | 4/1940 | United Kingdom | 134/102 |
| 595936 | 12/1947 | United Kingdom | 134/102 |

*Primary Examiner*—Philip R. Coe

*Attorney, Agent, or Firm*—Ferrill & Logan

[57] ABSTRACT

An apparatus is disclosed which provides a low temperature mist of cleaning liquid for cleaning jewelry and gems, and, particularly, sensitive gems which cannot withstand harsher methods of cleaning. The apparatus also provides a stream of warmed compressed air for drying the jewelry once cleaned.

18 Claims, 3 Drawing Sheets

LOW TEMPERATURE APPARATUS FOR CLEANING JEWELRY AND GEMS

BACKGROUND OF THE INVENTION

1. Field of the Invention

The present invention relates to apparatus for cleaning jewelry and gems. In particular, the present invention provides apparatus for cleaning jewelry and precious and semi-precious stones with a low temperature mist.

2. Background of the Invention

For many years it has been common practice to use available pressurized steam cleaning apparatus to clean jewelry and gems on a commercial basis. This apparatus is effective and allows for rapid, concentrated, and controlled cleaning. However, the apparatus inflicts the gems to very harsh conditions.

It has been found that certain precious and semi-precious stones may be marred or completely ruined when exposed to steam. These include: emeralds, which may lose post-cutting oils upon exposure to steam thus bringing imperfections to the surface; silicate stones, such as opals, which lose moisture content upon exposure to steam and may fracture; and quartz stones, such as amethyst and citrine, and tourmaline stones and topaz, which may fracture upon extreme changes in temperature. At the present time, the only safe way to clean such stones is laboriously washing them by hand.

It is a primary object of the present invention to provide apparatus which provides the cleaning benefits of pressurized steam cleaning apparatus without the undesirable high temperatures of steam.

It is a further object of the present invention to provide a low temperature cleaner which quickly and easily cleans and dries all forms of jewelry and gems without risk or injury to the gems or the operator.

SUMMARY OF THE INVENTION

The present invention provides an apparatus for relatively low temperature cleaning of jewelry and precious and semi-precious gems.

The invention comprises a compressed gas system and a cleaning liquid system. The two systems discharge through tubes at a common cleaning zone. The discharge of the two systems are oriented so that the flow of the discharging compressed gas past the liquid discharge tube causes a low pressure area which draws liquid from the discharge tube and atomizes the liquid into a cleaning mist. Thermostatically controlled heaters may be provided in each of the systems to raise the temperature to a suitable level of 84° to 104° F. at six inches from the orifice. Operator controlled pedals are provided to open one or both of the two discharge tubes.

In operation, a gem is cleaned by placing it in the cleaning zone and opening both discharge tubes to release a relatively low temperature cleaning mist. Once cleaned, the flow is ceased from the liquid discharge tube and the gem may be dried using just the heated compressed gas.

The present invention provides an improved cleaning apparatus which quickly and effectively cleans and dries all forms of gems and jewelry using a relatively low temperature mist. The invention has the benefits of pressurized steam cleaning apparatus but it will not damage delicate gems which cannot withstand the intensity of steam cleaning.

DETAILED DESCRIPTION OF THE INVENTION

The present invention is a low temperature cleaning apparatus for cleaning jewelry and precious and semi-precious gems.

Figure 1:
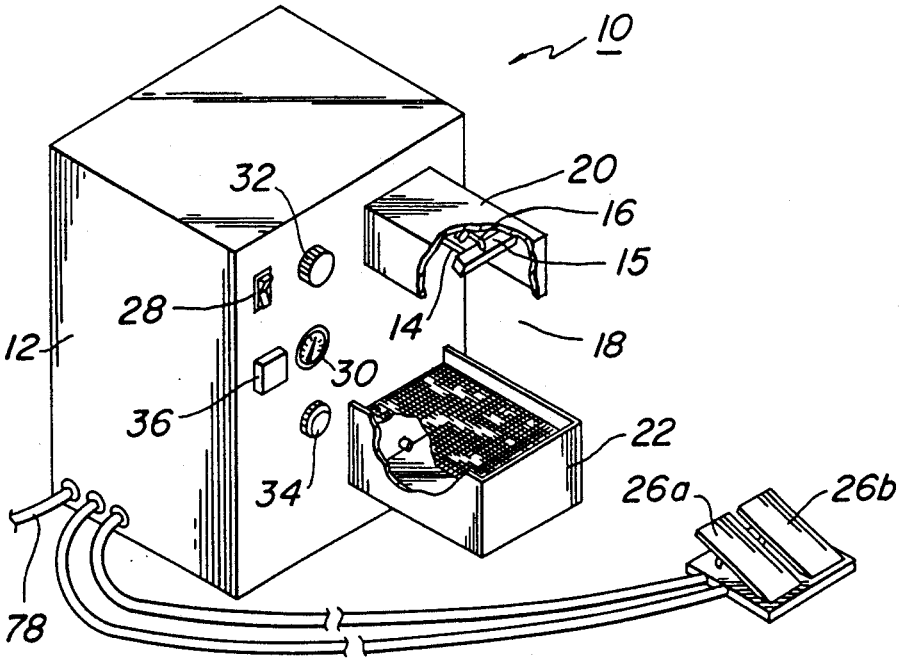
FIG. 1 is a perspective view of the cabinet and control pedals of the present invention.

As is shown in FIG. 1, the cleaning apparatus 10 is contained in a cabinet 12 having a cleaning liquid discharge tube 14 and a compressed gas discharge tube 16, discharging into a junction 15 which provides a common discharge opening into a cleaning zone 18. The cleaning zone 18, which is the area within approximately 6 inches of the junction 15, may be provided with a hood 20, to restrict the area of discharge, and a trough 22, to collect excess cleaning liquid which may precipitate from the cleaning zone 18.

Figure 3:
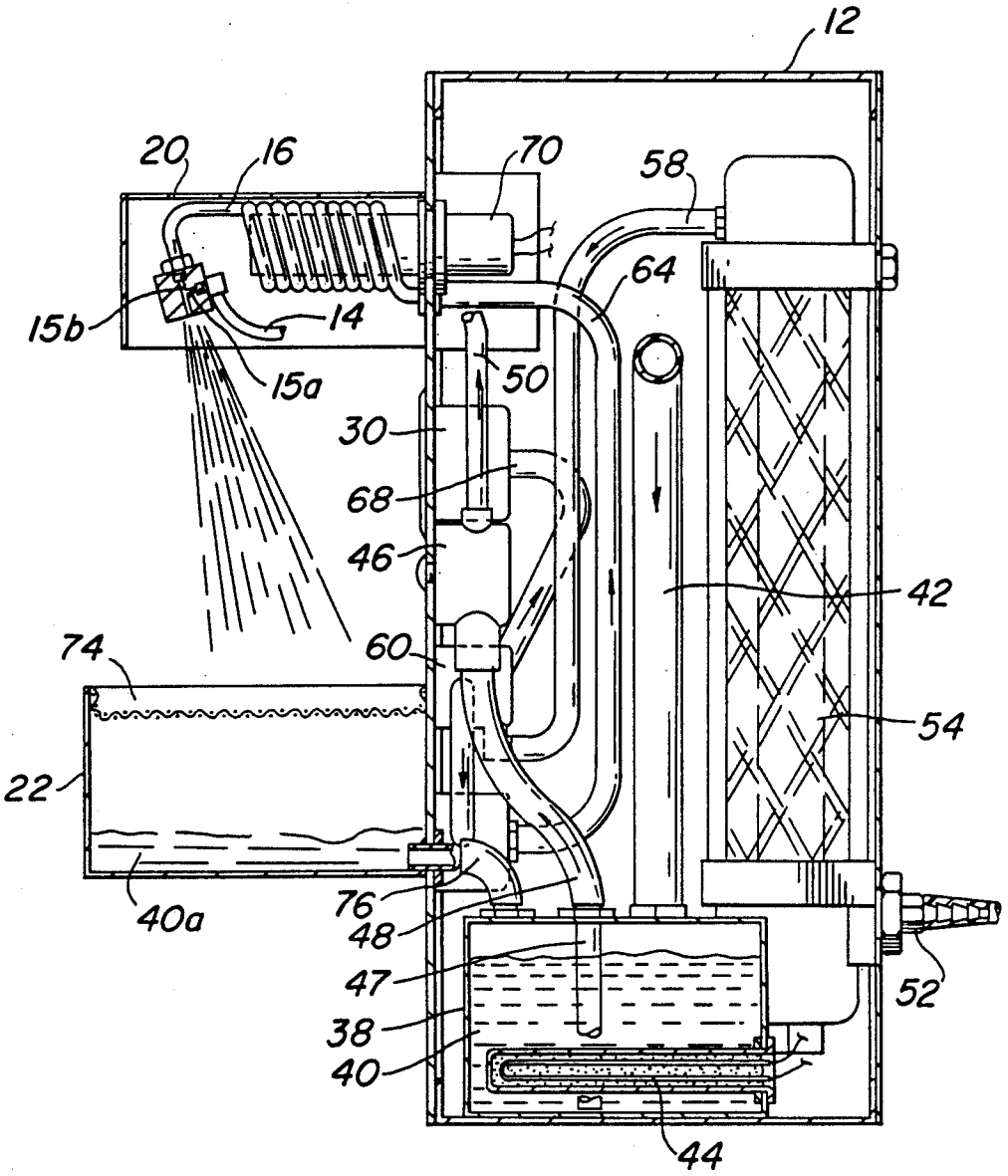
FIG. 3 is a sectional view of the components of the present invention along line 3—3 of FIG. 2.

As is explained in more detail below and as shown in FIG. 3, a cleaning liquid, such as water or a cleaning solution such as distilled water or ammonia solution, from a liquid system is drawn through the liquid discharge tube 14 and into junction 15 by compressed gas blowing past a liquid discharge opening **15*a* within junction 15**.

Compressed gas, preferably air, from a gas system is released from the gas discharge tube 16 which discharges into junction 15 via gas discharge opening **15*b*. Gas discharge opening 15*b* is presented substantially perpendicular to the liquid discharge opening 15*a***.

Flow through each of the liquid discharge tube 14 and the gas discharge tube 16 is controlled by valves which are operated by switches **26*a* and 26*b*, respectively. When switch 26*a* is activated, both switches are open. A flow of compressed air from the gas discharge tube 16 past the liquid discharge tube 14 within junction 15 creates an area of low pressure which draws cleaning liquid from the discharge tube 14 and then atomizes the liquid into a fine cleaning mist. When switch 26*b* is activated, only the gas valve is opened. The resulting flow of only compressed gas is an effective drying means. Ideally, the switches 26*a* and 26*b*** are foot activated pedals which leave both of the operator's hands free to handle delicate gems and jewelry.

Also present on the cabinet 12 are an on-off power switch 28, a gas pressure gauge 30, a liquid temperature thermostat 32, a gas pressure regulator 34, and a fuse access panel 36. Gauges may also be provided to monitor gas temperature, liquid temperature, and/or the amount of cleaning liquid in the apparatus 10.

Figure 2:
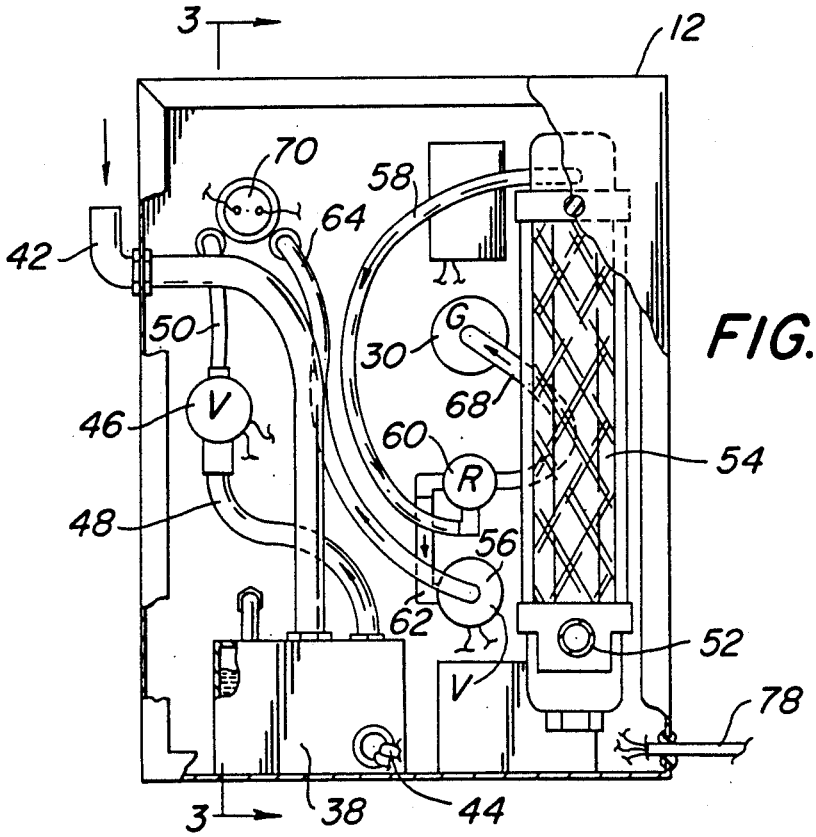
FIG. 2 is a sectional view of the cabinet of FIG. 1 showing components of the present invention.

Shown in FIGS. 2 and 3 are the internal components of the apparatus 10. A cleaning liquid reservoir 38 is provided which is filled with cleaning liquid 40 through fill tube 42. In the preferred embodiment the liquid reservoir 38 is provided with a submerged thermostatically controlled heater 44, such as a Watlow Firerod No. 8645 heater. The heater may be controlled by rheostat 32. For all kinds of gems, the cleaning liquid 40 should be maintained at a temperature of approximately 100° F. at 6 inches from junction 15. The ideal range of temperature in the liquid reservoir 38 is 100° to 180° F. This produces a range of temperature in the cleaning zone 18 of 84° to 104° F.

A solenoid switch valve 46, such as a 2 way N.C. Versch EZ-243 valve, is provided to control the flow of cleaning liquid 40 through tubes 47 and 48. This valve 46 is controlled by switch 26*a*.

Compressed gas is generated by a conventional remote gas compressor (not shown) which supplies air or other suitable gas through gas intake 52. The gas is then filtered by a gas filter 54. The filter 54 shown is a Deltech No. 110 filter unit.

Solenoid switch valve 56, such as another Versch EZ-243 valve, is provided to control the flow of gas through the gas system. This valve 56 is controlled by both switches 26*a* and 26*b*. When either switch 26*a* or 26*b* is activated the gas is then pumped through conduit 64 to gas discharge tube 16. A pressure regulator 60, such as a 3-100 psi Norgren R07-100-RNKA pressure regulator, maintains the compressed gas pressure of the gas system between 60 and 80 psi. A pressure gauge 30 connects to the regulator 60 via conduit 68.

As is shown in FIG. 3, a gas heater 70, such as a Watlow Firerod No. 8652 heater, is provided within the coiled gas discharge tube 16. Ideally the discharge tube 16 should encircle the heater approximately 8 to 15 times to achieve the correct discharge temperatures. In the preferred embodiment, the discharge tube 16 is a nickle-plated copper tube. Since the contact temperature of the gas on the jewelry can be controlled in the cleaning zone 18 by moving the jewelry closer to or farther from the junction 15, the gas temperature need not be closely monitored. However, a rheostat may be provided to control more closely the gas heater if desired. In either event, for drying gems the heater 70 should maintain the temperature of the gas entering the cleaning zone 18 at approximately 126° F. at 6 inches from junction 15.

As is shown in FIG. 3, the trough 22 is provided with a screen 74, which both lessens splatter from precipating mist and acts as a filtering means for the cleaning liquid 40. The used cleaning liquid 40*a* may be returned to the liquid reservoir 38 via a tube 76 or may be drained away for disposal. If the liquid 40*a* is returned to the reservoir 38, it may be desirable to further filter the liquid before it is reused by placing a second filter element (not shown) between the trough 22 and the reservoir 38.

Figure 4:
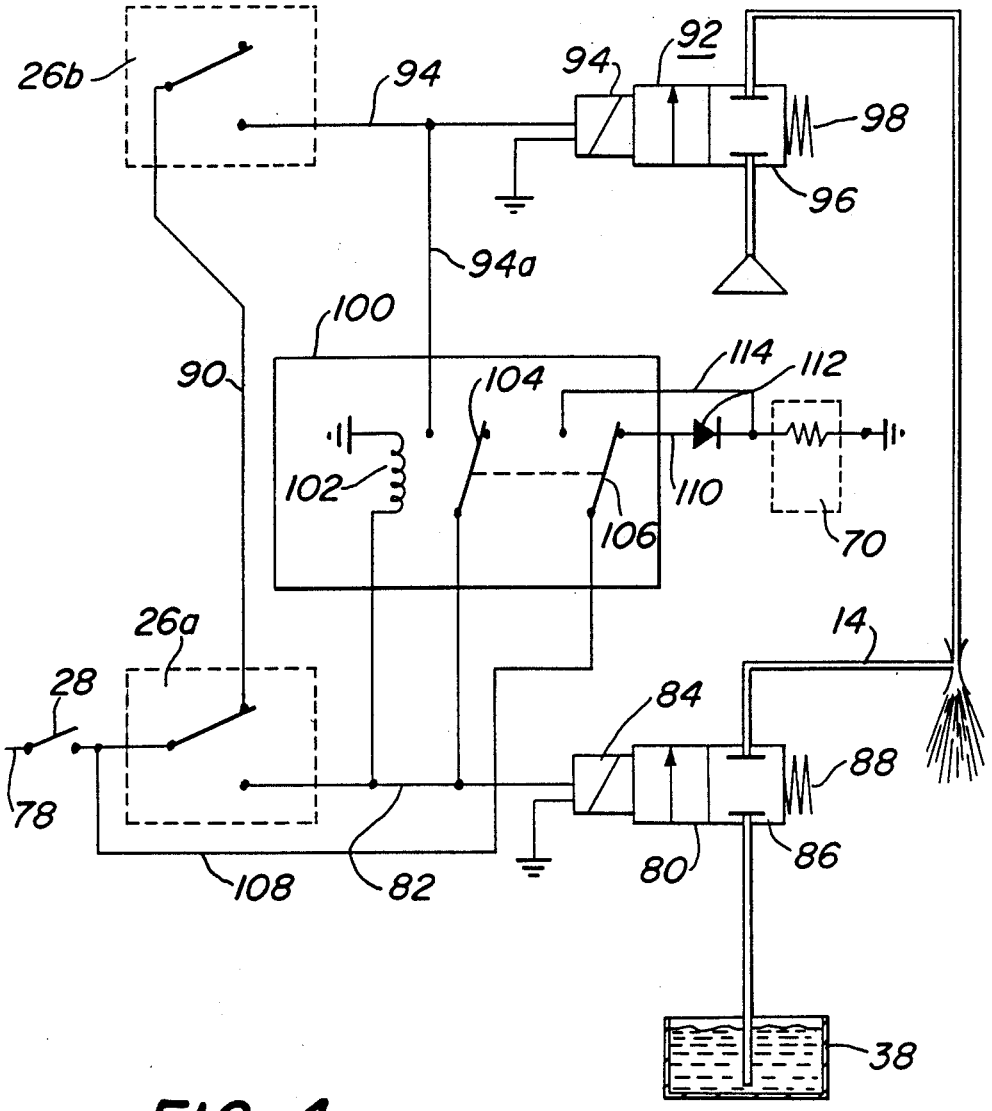
FIG. 4 is a wiring diagram of the present invention.

A schematic representation of the preferred electrical circuit of the present invention is shown in FIG. 4. Power enters via line 78 through switch 28. Switch 26*a* enables the liquid valve element 80 via line 82. The liquid valve element comprises a coil 84, a valve member 86 and a spring return 88. In the closed position shown, switch 26*a* enables switch 26*b* via line 90. When switch 26*b* is closed, it enables gas valve element 92 via line 94. The gas valve element 92 comprises a coil 94, a valve member 96, and a spring return 98.

A relay 100 is provided which comprises a coil 102 and two joined switch elements 104 and 106. In the open position shown, the relay powers only gas heater 70 via lines 108 and 110 and power reduction diode 112. The power reduction diode 112, such as a No. 1N5406 diode, limits electrical current to one direction and reduces the voltage by a quarter. When switch 26*a* is closed, coil 102 closes switches 104 and 106 simultaneously. This completes the gas valve enable circuit via line 94*a* and enables the gas heater 70 via line 114. The switch between lines 110 and 114 avoids the power reduction diode 112 to the gas heater, thus automatically increasing the heat produced by the heater to assure that the gas mixing with cleaning liquid is more thoroughly heated. The effect of this circuit is to assure that compressed gas is always released automatically when liquid switch 26*a* is activated.

In operation the apparatus of the present invention provides an effective means of both cleaning and drying all forms of gems and jewelry. The jewelry is simply placed in the cleaning zone 18 and washed in the mist. The jewelry may be rubbed or brushed in order to free dirt particles while the mist is applied. Once cleaned, the jewelry may be readily dried using only the warmed compressed gas. Although the apparatus is as effective as available steam cleaning devices, it does not inflict sensitive gems to the unacceptable harsh conditions of steam cleaners.

While particular embodiments of the present invention have been disclosed herein, it is not intended to limit the invention to such a disclosure and changes and modifications may be incorporated and embodied within the scope of the following claims.

What is claimed is:

1. An apparatus for low temperature cleaning of jewelry or sensitive gems which comprises:

a liquid system containing a cleaning liquid of water;

means for delivery of said liquid as a mist into a cleaning zone, and including means to maintain the temperature of the mist delivered into the cleaning zone substantially between 84° and 104° F.;

a compressed gas system;

means for delivery of compressed gas from said gas system into said cleaning zone;

means to control the delivery of said compressed gas; and means to control the delivery of said liquid.

2. The apparatus of claim 1 wherein said means for delivery of said liquid as a mist into a cleaning zone comprises:

a liquid discharge tube from the liquid system exiting into said cleaning zone;

a gas discharge tube from the gas system exiting into said cleaning zone in a common area with said liquid discharge tube;

wherein the discharge of the compressed gas both draws liquid from said liquid discharge tube and atomizes said liquid into a mist.

3. The apparatus of claim 2 wherein means are provided to regulate the pressure of said compressed gas.

4. The apparatus of claim 3 wherein the pressure of said gas in said gas system is maintained between 60 and 80 psi.

5. The apparatus of claim 2 wherein means are provided in said gas system to regulate the temperature of said gas.

6. The apparatus of claim 5 wherein the means to regulate the temperature of said gas comprises a heating unit in said gas system.

7. The apparatus of claim 5 wherein the temperature of the gas discharged into the cleaning zone is maintained at a temperature of approximately 126° F.

8. The apparatus of claim 2 wherein means are provided in said gas system to filter said gas.

9. The apparatus of claim 2 wherein the gas discharge tube is oriented substantially perpendicular to said liquid discharge tube.

10. The apparatus of claim 9 wherein the means for delivery of said liquid as a mist into a cleaning zone and maintain the gas discharge tube substantially perpendicular to the liquid discharge tube is a T-joint junction.

11. The apparatus of claim 1 wherein the means for regulating the temperature of the cleaning liquid in the liquid system comprises:

a heating unit submerged in a reservoir of said liquid; and a thermostat which monitors the temperature of said liquid and controls said heating unit.

12. The apparatus of claim 11 wherein the temperature of the liquid in said reservoir is maintained at a temperature between 100° and 180° F.

13. The apparatus of claim 1 wherein means are provided to collect liquid which precipitates from the cleaning zone.

14. The apparatus of claim 13 wherein the means provided to collect the liquid which precipitates from the cleaning zone comprises a trough beneath said cleaning zone.

15. The apparatus of claim 14 wherein means are provided to filter the liquid collected in said trough and to recycle said liquid to said liquid system.

16. The apparatus of claim 1 wherein the means to control the delivery of said compressed gas and the means to control the delivery of said liquid are separate switches connected to flow valves in the respective systems.

17. The apparatus of claim 16 wherein said switches are foot pedals.

18. An apparatus for cleaning sensitive gems, which apparatus comprises:

an aqueous cleaning liquid system and a compressed gas system, said systems each having a point of discharge located at a common cleaning zone;

said cleaning liquid system comprising a liquid reservoir with liquid heating means and means to maintain the temperature of said liquid within a range of 84° to 104° F. within the cleaning zone;

said compressed gas system comprising a pressure regulator, a filter, and means to regulate the temperature of said gas;

the point of discharge of said compressed gas system being oriented so to draw liquid from the cleaning liquid system at the point of discharge of the liquid system and atomize said liquid into a cleaning mist;

means to control the discharge from the cleaning liquid system; and means to control the discharge from the gas system.

* * * * *